United States Patent [19]

Helmich, Jr.

[11] Patent Number: 4,911,649

[45] Date of Patent: Mar. 27, 1990

[54] ELECTRICAL CONVERTER DEVICE

[76] Inventor: Daniel F. Helmich, Jr., 1059 N. Fayette, Jacksonville, Ill. 62650

[21] Appl. No.: 310,933

[22] Filed: Feb. 16, 1989

[51] Int. Cl.[4] ..... H01R 29/00

[52] U.S. Cl. ..... 439/170; 439/172; 439/173; 439/652

[58] Field of Search ..... 439/119, 170, 171, 173–175, 439/221, 652

[56] References Cited

U.S. PATENT DOCUMENTS

| | | | |
|---|---|---|---|
| 2,450,657 | 10/1948 | Guernsey | 439/173 |
| 2,989,719 | 6/1961 | Aarlaht | 439/172 |
| 2,994,849 | 8/1961 | Mussari, Jr. | 439/652 |
| 4,085,996 | 4/1978 | Koslo | 439/652 |
| 4,740,167 | 4/1988 | Millhimes et al. | 439/170 |

*Primary Examiner*—P. Austin Bradley

*Attorney, Agent, or Firm*—Leon Gilden

[57] ABSTRACT

A plug-in electrical converter device is set forth wherein a removable face containing one of a plurality of various 220 volt connector plugs is selectively securable to a housing containing a plurality of 110 volt outlets with the housing containing a slide connector electrically engageable with a respective strip. Each of the strips accepts one phase of the 220 volt connector plug with a central resilient slide to provide the neutral conductor.

5 Claims, 5 Drawing Sheets

ELECTRICAL CONVERTER DEVICE

BACKGROUND OF THE INVENTION

1. Field of the Invention

The present invention relates to electrical outlet plugs, and more particularly pertains to a new and improved electrical converter device wherein the same converts 220 volt current to a plurality of 110 volt outlets while simultaneously requiring the correct registration of a rearwardly mounted face plate to the housing of the apparatus.

2. Description of the Prior Art

The use of multiple outlets is well known in the prior art to enable the attachment of various electrical devices into a single outlet source. It is understood that there are many 220 volt outlets that are not continuously utilized for servicing of such devices as air conditioners, stoves and the like. Accordingly, it is desired to utilize these outlets and convert the same into a plurality of 110 volt outlets for accommodating the myriad of electrical appliances requiring such voltage. Unfortunately there are many configurations of 220 volt outlet receptacles requiring a mating 220 volt plug. The present invention, as opposed to the prior art, accommodates the variations in 220 volt outlet receptacles, as opposed to the prior art. For example. U.S. Pat. No. 3,349,363 to Goodman sets forth an electrical converter wherein the Goodman patent is representative of the prior art not accommodating variations in 220 outlet receptacles with associated 220 outlet plugs. The Goodman patent sets forth the overall teaching of converting 220 volt current to 110 volt current.

U.S. Pat. No. 3,509,356 to Peebles sets forth an outlet adapter utilizing a plurality of outlet terminals enabling certain appliances to be selectively utilized under full power or half power. The patent is of interest relative to the accommodation of a variety of appliances. but is remote relative to the teaching of the instant invention setting forth a plurality of selectively securable outlet plugs with an outlet housing wherein correct registration of the outlet plug face must be provided prior to utilization of the instant invention.

U.S. Pat. No. 3,938,068 to Hagan sets forth an electrical plug associated with a 220 volt type outlet including a fuse in a conductive path so the current flowing through the plug and outlet must flow through the fuse to ensure an element of safety. The patent is of interest relative to the overall teaching of converting 220 volt power to 110 volt power for subsequent utilization by an individual.

U S. Pat. No. 3,997,225 to Horwinski utilizes a typical plug associated with a grounding screw securable to a typical outlet for providing multiple 110 volt type outlets from a 110 volt source.

As such, it may be appreciated that there is a continuing need for a new and improved electrical converter device which addresses both the problems of adaptability to a variety of 220 volt outlets as well as convenience and safety in its implementation, and in this respect, the present invention substantially fulfills this need.

SUMMARY OF THE INVENTION

In view of the foregoing disadvantages inherent in the known types of electrical converter devices now present in the prior art, the present invention provides an electrical converter device wherein the same may be conveniently manipulated to position an associated 220 volt plug with a complementarily configured receptacle As such, the general purpose of the present invention, which will be described subsequently in greater detail, is to provide a new and improved electrical converter device which has all the advantages of the prior art electrical converter devices and none of the disadvantages.

To attain this, the present invention comprises an electrical conver&er device wherein the same utilizes a 220 volt plug integrally secured to a face slidably securable to an associated housing. The face includes a plurality of spring contacts electrically associatable with contact strips onto a confronting part of the housing. The medial neutral prong of the 220 volt plug associates with a strip positioned a height originating at a point below the uppermost level of the housing wherein the sliding face must be in a predetermined registration relative to the housing to effect electrical contact and enabl utilization of the multiple 110 volt outlets utilized with the instant invention.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electrical converter device which has all the advantages of the prior art electrical converter device and none of the disadvantages.

It is another object of the present invention to provide a new and improved electrical converter device which may be easily and efficiently manufactured and marketed.

It is a further object of the present invention to provide a new and improved electrical converter device which is of a durable and reliable construction.

An even further object of the present invention is to provide a new an improved electrical converter device which is susceptible of a low cost of manufacture with regard to both materials and labor, and which accordingly is then susceptible of low prices of sale to the consuming public. thereby making such electrical converter device economically available to the buying public.

Still yet another object of the present invention is to provide a new and improved electrical converter device which provides in the apparatuses and methods of the prior art some of the advantages thereof, while simultaneously overcoming some of the disadvantages normally associated therewith.

Still another object of the present invention is to provide a new and improved electrical converter device wherein the same enables utilization of a variety of 220 volt plugs with a single housing and wherein the plug and its associated face must be in desired registration with the associated housing.

These together with other objects of the invention along with the various features of novelty which characterize the invention, are pointed out with particularity in the claims annexed to and forming a part of this disclosure. For a better understanding of the invention, its operating advantages and the specific objects attained by its uses. reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
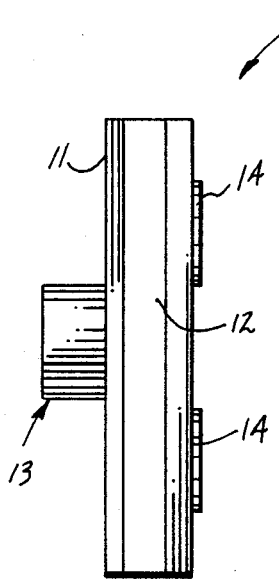
FIG. 1 is an orthographic side view of the instant invention.

With reference now to the drawings, and in particular to FIGS. 1 to 5 thereof, a new and improved electrical converter device embodying the principles and concepts of the present invention and generally designated by the reference numeral 10 will be described.

Figure 2:
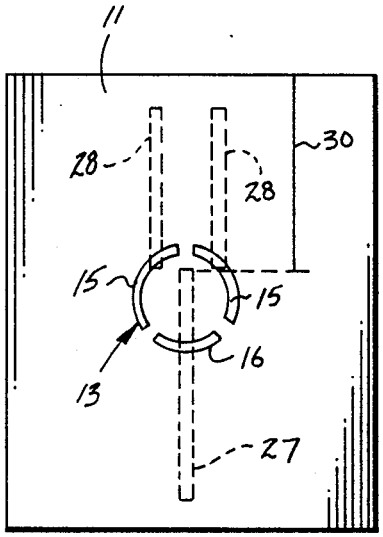
FIG. 2 is an orthographic rear view of the instant invention.
Figure 2A:
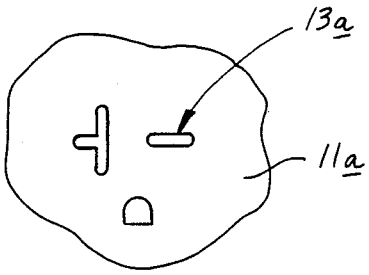
FIG. 2*a*, 2*b*, and 2*c* are representative of various connector plugs utilized with associated sliding faces of the instant invention.
Figure 2B:
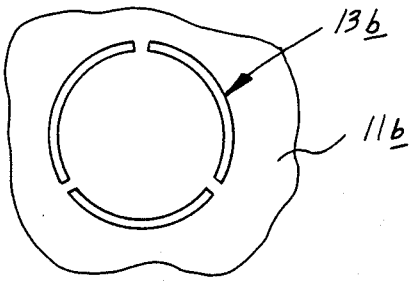
Figure 2C:
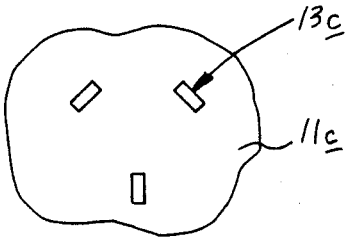
Figure 3:
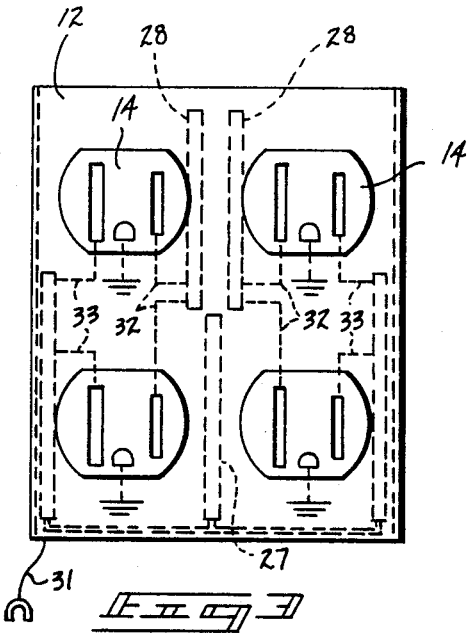
FIG. 3 is an orthographic frontal view of the instant invention.

More specifically, the electrical device 10 essentially comprises a face plate 11 slidingly securable to an outlet housing 12. The face plate 11 includes a tri-prong connector 13 characteristic of 220 volt connectors. FIGS. 2*a*, 2*b*, and 2*c* are illustrative of other tri-prong connectors illustrated as 13*a*, 13*b*, and 13*c* associated with respective face plates 11*a*, 11*b*, and 11*c*. The outlet housing 12 is provided with a plurality and preferably four outlets 14 of convention 110 volt configuration.

Figure 4:
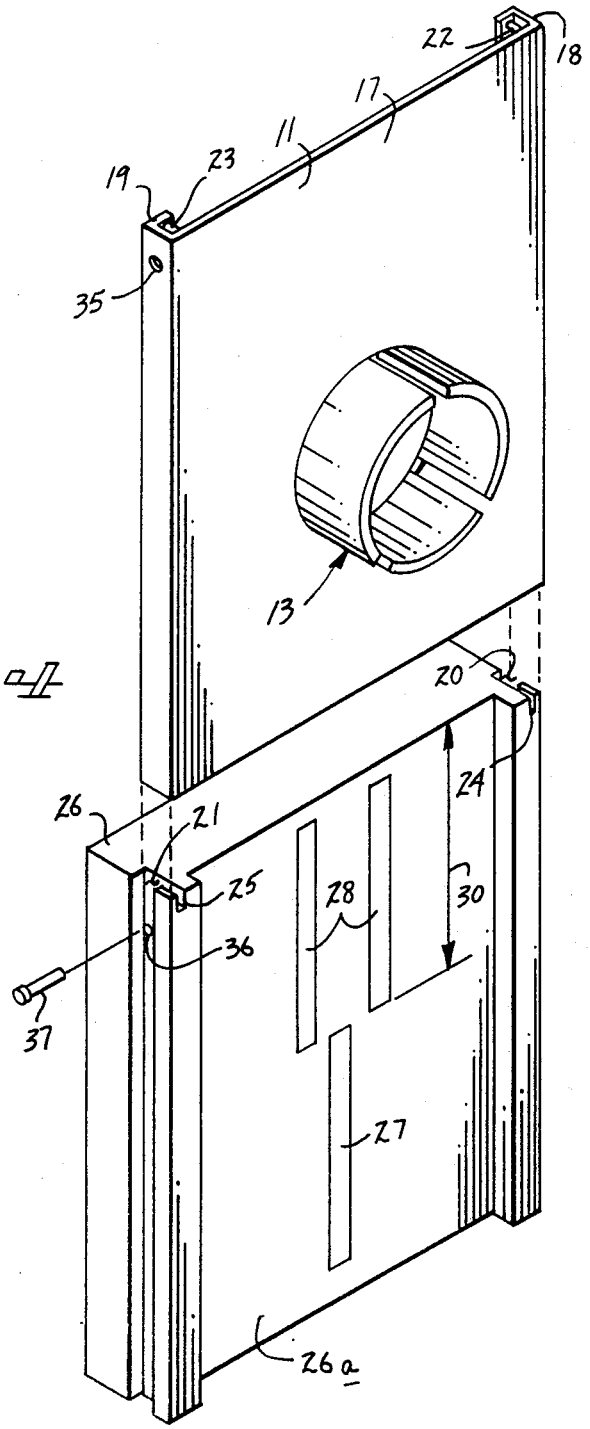
FIG. 4 is an isometric exploded view of the instant invention.
Figure 5:
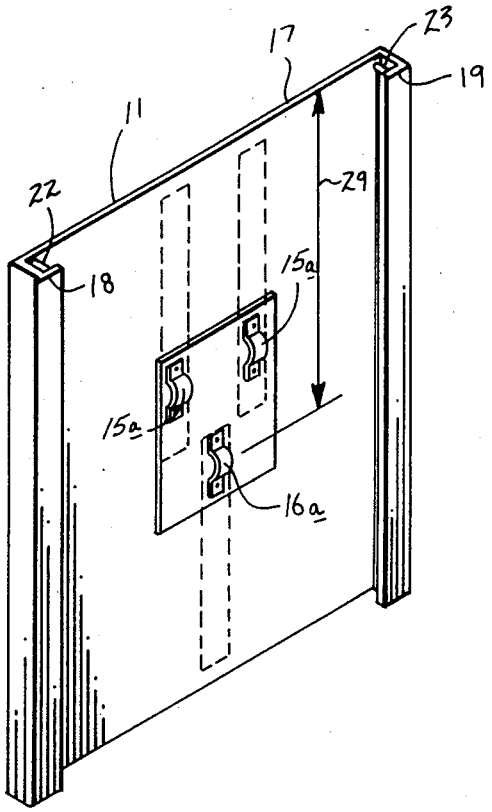
FIG. 5 is an isometric rear view of the face plate of the instant invention.

The tri-prong connector 13 includes two conductor prongs 15 and a ground prong 16. In electrical communication with the two conductor prongs 15 are two "U" shaped resilient first contacts 15*a* extending rearwardly of the face plate 11. as illustrated in FIG. 5, of a rea face of the aforenoted face plate. Extending rearwardly and spaced below the first contacts 15*a* is a second "U" shaped resilient contact 16*c* in electrical whole communication through the face plate to the ground prong 16. Formed to each terminal side edge of the face plate 11 are first and second inwardly directed "L" shaped flanges 18 and 19 extending along the height of the face plate 11. A first elongate slot 20 and a second elongate slot 21 formed along the height of the outlet housing 12 matingly accepts the respective first and second flanges 18 and 19 in a complementary manner, as illustrated in FIG. 4 for example. A first registration pin 22 extends adjacent the top surface 17 of the face plate 11 with a similar second registration pin 23 spanning distance between respective legs of the "L" shaped first and second flanges 18 and 19 with a rear face of the face plate 11. The first and second registration pins 22 and 23 are complementarily received within first and second recesses 24 and 25 formed within the top surface 26 of the housing I2. When the first and second registration pins 22 and 23 are received from the first and second recesses 24 and 25, the neutral strip 27 formed medially and extending from a lowermost edge of the interior surface 26*a* of the housing 12 is in electrical communication with the associated second "U" shaped contact 16*a*. Similarly, the first "U" shaped contacts 15*a* are in electrical communication with the connector strips 28 positioned above the neutral strip 27 and spaced outwardly thereof in alignment with the first "U" shaped resilient contacts 15*a*. The registration of the respective first and second registration pins 22 and 23 within the respective first and second recesses 24 and 25 indicate such communication in as much as the ground prong 16 is spaced below the top surface 17 of the face plate 11 a first fixed distance 29 wherein the neutral strip 27 has a top edge spaced a second fixed distance 30 below the top surface 26 of the housing 12.

It is noted that the housing 12 includes a ground strap 31 for grounding of the converter device 10. Each of the outlets 14 are in turn provided with electrical communication line 32 to a single one of the connector strips 28 and to the neutral strip 27 neutral connection line 33 to provide a 110 volt power source converted from the 220 volt power source received by the tri-prong connector 13.

Furthermore, upon proper registration of the respective first and second registration pins 22 and 23 within the complementarily shaped first and second recesses 24 and 25, a first bore 35 within the second flange 19 is in alignment with a second bore 36 within the housing 12 to thereby receive a connector pin 37 therethrough. In this manner, the connector prongs 15 and the ground prong 16 are in a desired registration with the respective connector strips 28 and neutral strip 27 formed on the interior face of the housing 12. Improper registration of the face plate 11 to the outlet housing 12 will not permit the securement of the connector pin 37 through the first and second alignable bores 35 and 36 nor will the first and second registration pins 22 and 23 be received with the first and second recesses 24 and 25 for visual indications of improper registration of the plate 11 to the housing 12 preventing use of the apparatus in an unsafe condition exposing an individual to the electrical energy of the various connector strips within the housing 12.

It is to be understood that the face plate 11 and outlet housing 12 are typically formed of non-conductive material to provide an insulative environment to the various conductive strips as is conventional in the electrical outlet arts.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An electrical converter device adapter to be plugged into a tri-hole outlet wherein two of the holes are high voltage holes and the remaining hole providing a neutral contact, said device comprising, a housing including a top face, spaced side faces, an exterior face, and an interior face, and a face plate member including a top surface, spaced side surfaces, an exterior surface, and an interior surface, and a first and second prong conductor extending outwardly of said exterior surface for electrical communication with said two of the holes, and a third prong ground underlying said first and second prongs medially thereof for electrical communication with said remaining hole, and each of said first and second prong conductors in electrical communication with a contact extending outwardly of said interior surface, and said third prong ground in electrical communication with a further contact underlying and positioned medially of each of said contacts and extending outwardly of said interior surface, and a plurality of connector strip means secured to said interior face for electrical communication with said first. second, and third prongs wherein said face plate is securable to said housing with a plurality of outlet members secured o said exterior face of said housing wherein each outlet member is in electrical communication with one of said first and second prongs and said third prong through said connector strip means.

2. An electrical converter device as set forth in claim 1 wherein the side surfaces of said face plate member includes "L" shaped members extending in a spaced array to said interior surface for sliding association with respective slots formed in each of said spaced side faces of said housing.

3. An electrical converter device as set forth in claim 2 wherein said face plate member further includes a registration pin in alignment with said top surface and extending between said "L" shaped members and said interior surface, and a recess formed adjacent each slot in said housing on the top face of said housing for complementarily receiving each of said registration pins.

4. An electrical converter device as set forth in claim 3 wherein one of said side surfaces includes a first opening and wherein one of said side faces includes a second opening wherein said first and second opening are in axial alignment with on another when said face plate member is slidably secured to said housing, and a connector pin receivable within said first and second openings when said face plate member is secured to said housing.

5. An electrical converter device as set forth in claim 4 wherein said connector strip means includes a first and second connector strip for electrical communication with said first and second prongs wherein said first and second connector strips extend downwardly proximate said top face of said housing along said interior face, and a neutral strip extending upwardly from said interior face proximate a lowermost edge of said interior face wherein said neutral strip is spaced from said top face a distance substantially equal to a spacing defined by said further contact spaced from said top surface.

* * * * *